US009194615B2

(12) United States Patent
Lesmerises et al.

(10) Patent No.: US 9,194,615 B2
(45) Date of Patent: Nov. 24, 2015

(54) $CO_2$ COOLING SYSTEM AND METHOD FOR OPERATING SAME

(71) Applicant: Marc-André Lesmerises, Trois-Rivières (CA)

(72) Inventors: Marc-André Lesmerises, Trois-Rivières (CA); Tommy Dolbec, Batiscan (CA)

(73) Assignee: Marc-Andre Lesmerises, Trois-Rivieres, Quebec (CA)

( * ) Notice: Subject to any disclaimer, the term of this patent is extended or adjusted under 35 U.S.C. 154(b) by 207 days.

(21) Appl. No.: 13/894,034

(22) Filed: May 14, 2013

(65) Prior Publication Data

US 2014/0298833 A1 Oct. 9, 2014

Related U.S. Application Data

(60) Provisional application No. 61/808,826, filed on Apr. 5, 2013.

(51) Int. Cl.
*F25B 9/00* (2006.01)

(52) U.S. Cl.
CPC ..... *F25B 9/008* (2013.01)

(58) Field of Classification Search
CPC ..... F25B 9/008; F25B 9/00; F25B 9/10; F25B 31/00; F25B 39/00
USPC ..... 62/115, 498, 509, 510
See application file for complete search history.

(56) References Cited

U.S. PATENT DOCUMENTS

| | | | |
|---|---|---|---|
| 63,404 | A | 4/1867 | Lowe |
| 73,936 | A | 1/1868 | Somes |
| 118,649 | A | 8/1871 | Sears |
| 152,269 | A | 6/1874 | Beins |

(Continued)

FOREIGN PATENT DOCUMENTS

| | | | |
|---|---|---|---|
| CA | 2283605 | A1 | 3/2001 |
| CA | 2369330 | A1 | 8/2002 |

(Continued)

OTHER PUBLICATIONS

Adriansyah, W., Combined Air-Conditioning and Tap Water Heating Plant, Using CO2 As Refrigerant for Indonesian Climate Condition, Thesis, Norwegian University of Science and Technology, Faculty of Mechanical Engineering,Department of Refrigeration and Air-conditioning, Apr. 2001, 238 pages, USA.

(Continued)

*Primary Examiner* — Mohammad M Ali
(74) *Attorney, Agent, or Firm* — Merchant & Gould P.C.

(57) ABSTRACT

There is provided a $CO_2$ cooling system which comprises: a compression stage in which $CO_2$ refrigerant is compressed; a cooling stage in which the $CO_2$ refrigerant releases heat; and an evaporation stage in which $CO_2$ refrigerant, having released heat in the cooling stage, absorbs heat. The $CO_2$ refrigerant exiting the evaporation stage is directed to at least one of the compression stage, before being directed to the cooling stage, and the cooling stage by at least one of gravity and natural convection. There is also provided a method for operating a $CO_2$ cooling system.

37 Claims, 4 Drawing Sheets

(56) References Cited

U.S. PATENT DOCUMENTS

| | | | |
|---|---|---|---|
| 196,653 | A | 10/1877 | Gamgee |
| 308,965 | A | 12/1884 | Henderson |
| 663,456 | A | 12/1900 | Muller |
| 1,923,472 | A | 8/1933 | Baird |
| 3,001,374 | A | 9/1961 | Hutton, Jr. |
| 3,307,372 | A | 3/1967 | Kenison |
| 3,400,550 | A | 9/1968 | Guiffre |
| 3,672,181 | A | 6/1972 | Tyree, Jr. |
| 4,510,761 | A | 4/1985 | Quarles |
| 5,245,836 | A | 9/1993 | Lorentzen et al. |
| 5,497,631 | A | 3/1996 | Lorentzen et al. |
| 6,021,646 | A | 2/2000 | Burley et al. |
| 6,216,481 | B1 | 4/2001 | Kantchev |
| 6,540,605 | B1 | 4/2003 | Lesage |
| 6,595,009 | B1 | 7/2003 | Howard et al. |
| 6,694,763 | B2 | 2/2004 | Howard |
| 6,807,813 | B1 | 10/2004 | Lesage |
| 6,962,059 | B2 | 11/2005 | Okaza et al. |
| 7,032,398 | B2 | 4/2006 | Dilk et al. |
| 7,096,679 | B2 | 8/2006 | Manole |
| 7,197,886 | B2 | 4/2007 | Lesage et al. |
| 7,210,303 | B2 | 5/2007 | Zhang et al. |
| 7,231,775 | B2 | 6/2007 | Dilk et al. |
| 7,310,960 | B2 | 12/2007 | Sienel et al. |
| 7,401,473 | B2 | 7/2008 | Lesage et al. |
| 7,530,235 | B2 | 5/2009 | Yamaguchi et al. |
| 7,644,593 | B2 | 1/2010 | Duraisamy |
| 7,716,943 | B2 | 5/2010 | Seefeldt |
| 7,721,569 | B2 | 5/2010 | Manole |
| 7,845,190 | B2 | 12/2010 | Pearson |
| 7,891,201 | B1 | 2/2011 | Bush et al. |
| 7,900,467 | B2 | 3/2011 | Allen |
| 8,316,654 | B2 | 11/2012 | Heinbokel et al. |
| 2001/0023594 | A1 | 9/2001 | Ives |
| 2006/0266058 | A1 | 11/2006 | Nemoto et al. |
| 2007/0199337 | A1 | 8/2007 | Otake et al. |
| 2007/0214829 | A1 | 9/2007 | Otake et al. |
| 2008/0011004 | A1 | 1/2008 | Lesage et al. |
| 2008/0223074 | A1 | 9/2008 | Pachai et al. |
| 2008/0289350 | A1 | 11/2008 | Shapiro |
| 2009/0120108 | A1 | 5/2009 | Heinbokel et al. |
| 2009/0260389 | A1 | 10/2009 | Dube |
| 2010/0023166 | A1 | 1/2010 | Chessel et al. |
| 2010/0147006 | A1 | 6/2010 | Taras et al. |
| 2011/0011104 | A1 | 1/2011 | Lesage et al. |
| 2011/0265983 | A1 | 11/2011 | Pedersen |
| 2012/0055182 | A1 | 3/2012 | Dube |
| 2012/0073319 | A1 | 3/2012 | Dube |
| 2012/0247148 | A1 | 10/2012 | Dube |

FOREIGN PATENT DOCUMENTS

| | | | |
|---|---|---|---|
| CA | 2599769 | A1 | 2/2009 |
| CA | 2662986 | A1 | 10/2009 |
| CA | 2760488 | A1 | 10/2009 |
| CA | 2638235 | A1 | 2/2010 |
| CA | 2738874 | A1 | 4/2010 |
| CA | 2744840 | A1 | 4/2010 |
| CA | 2744858 | A1 | 4/2010 |
| CA | 2735347 | A1 | 6/2011 |
| CA | 2746445 | A1 | 10/2011 |
| CA | 2724255 | A1 | 3/2012 |
| CA | 2771113 | A1 | 5/2012 |
| EP | 1794516 | B1 | 6/2007 |
| EP | 1921399 | A2 | 5/2008 |
| JP | 2001241785 | A | 9/2001 |
| JP | 2004101107 | A | 4/2004 |
| JP | 2004108617 | A | 4/2004 |
| JP | 2004339741 | A | 12/2004 |
| JP | 2006292229 | A | 10/2006 |
| JP | 4106685 | B2 | 6/2008 |
| JP | 2009036415 | A | 2/2009 |
| JP | 4241662 | B2 | 3/2009 |
| JP | 4987610 | B2 | 7/2012 |
| WO | 02066908 | A1 | 8/2002 |
| WO | 2006087011 | A1 | 8/2006 |
| WO | 2007022777 | A1 | 3/2007 |
| WO | 2007022778 | A1 | 3/2007 |
| WO | 2010045743 | A1 | 4/2010 |

OTHER PUBLICATIONS

Shahzad, K., An Ice Rink Refrigeration System Based on CO2 As Secondary Fluid in Copper Tubes, Master of Science Thesis, Master Program of Sustainable Energy Engineering, Department of Energy Technology, Royal Institute of Technology, 2006, 80 pages, Stockholm, Sweden.

Carnot Refrigeration, Formation CO2, Training guide, 33 pages, Oct. 1, 2009, Trois-Rivière, Québec, Canada.

Rogstam J, Status of Transcritical CO2 Systems in Ice Rinks Prior to 2010, Energi & Kylanalys, 3 pages, Sweden.

Elbel, S. et al., Effect of Internal Heat Exchanger on Performance of Transcritical CO2 Systems With Ejector, Purdue e-Pubs, Purdue University, International Refrigeration and Air conditioning conference, 2004, 9 pages.

Industri & Laboratoriekyl, Offer 50119 H, Appendix 2, 2006, 4 pages, Stockholm.

Dopazo et al., Theoretical analysis of a CO2—NH3 cascade refrigeration system for cooling applications at low temperatures, Applied Thermal Engineering, 2009, vol. 29, p. 1577-1583.

Kauf, Determination of the optimum high pressure for transcritical CO2-refrigeration cycles, International Journal of Thermal Science, 1999, vol. 38, p. 325-330.

Li et al., Transcritical CO2 refrigeration cycle with ejector-expansion device, International Journal of Refrigeration, 2005, vol. 28. p. 766-773.

Fangtian et al., Thermodynamic analysis of transcritical CO2 refrigeration cycle with an ejector, Applied Thermal Engineering, 2011, vol. 31, p. 1184-1189.

Eskandari et al., Performance of a new two-stage multi-intercooling transcritical CO2 ejector refrigeration cycle, Applied Thermal Engineering, 2012, vol. 40, p. 202-209.

Pearson, Carbon dioxide—new uses for an old refrigerant, International Journal of Refrigeration, 2005, vol. 28, p. 1140-1148.

Girotto et al., Commercial refrigeration system using CO2 as the refrigerant, International Journal of Refrigeration, 2004, vol. 27, p. 717-723.

Neska, CO2 heat pump systems, International Journal of Refrigeration, 2002, vol. 25, p. 421-427.

Dopazo et al., Theoretical analysis of a CO2-NH3 cascade refrigeration system for cooling applications at low temperatures, Applied Thermal Engineering, 2009, vol. 29, p. 1577-1583.

Rogstam, Ice rinks with carbon dioxide as secondary refrigerant, IUC Sveriges energi & Kyl centrum, 2010, p. 1-32.

Kauf, Determination of the optimum high pressure for transcritical CO2—refrigeration cycles, International Journal of Thermal Science, 1999, vol. 38, p. 325-330

Li et al., Transcritical CO2 refrigeration cycle with ejector-expansion device, International Journal of Refrigeration, 2005, vol. 28, p. 766-773.

Fangtian et al., Thermodynamic analysis of transcritical CO2 refrigeration cycle with an ejector, Applied Thermal Engineering, 2011, vol. 31, p. 1184-1189

Eskandari et al., Performance of a new two-stage multi-intercooling transcritical CO2 ejector refrigeration cycle, Thermal Engineering, 2012, vol. 40, p. 202-209.

Adriansyah, W., Combined Air-Conditioning and Tap Water Heating Plant, Using CO2 As Refrigerant for Indonesian Climate Condition, Thesis, Norwegian University of Science and Technology, Faculty of Mechanical Engineering, Department of Refrigeration and Air-conditioning, Apr. 2001, 238 pages, Usa.

Vestergaard et al., CO2 in Refrigeration Applications, The News Magazine, Oct. 2, 2013.

(56) References Cited

OTHER PUBLICATIONS

Kim, S. et al, The Performance of a Transcritical CO2 Cycle With an Internal Heat Exchanger for Hot Water Heating, International Journal of Refrigeration, Nov. 2005, p. 1064-1072, vol. 28, No. 7.

Rogstam, J., Ice Rink Refrigeration System With CO2 As Secondary Fluid, IIR International conference on Thermophysical Properties and Transfer Processes of Refrigerants. Vicenza, Italy. Aug. 30-31, 2005.

Nilsson et al., Ice Rink Refrigeration System With Carbon Dioxide As Secondary Fluid in Copper Tubes, 7th IIR Gustav Lorentzen Conference on Natural Working Fluids, 8 pages, May 28-31, 2006, Norway.

Hrnjak, P., Cascade Systems and Accomodating High Pressure, Creative Thermal Solutions Inc, 10th short course in Supermarket Refrigeration, 8 pages, Feb. 23-24, 2010, Illinois, USA.

Neska et al., CO2—A Refrigerant From the Past With Prospects of Being One of the Main Refrigerants in the Future, 9th IIR Gustav Lorentzen conference 2010, natural refigerants—real alternatives, Sydney, Apr. 12-14, 2010.

Bellstedt, M. et al, Application of CO2 (R744) Refrigerant in Industrial Cold Storage Refrigeration Plant, Forum Application, The official journal of ARAH, p. 25-30, Jun. 2002.

Nguyen, T, Carbon Dioxide in Ice Rink Refrigeration, KTH Industrial Engineering and Management, 65 pages, Sep. 2012.

Sharp, D., Cupori, Winter Sports Arena, 26 pages, Nov. 26, 2009.

$CO_2$ COOLING SYSTEM AND METHOD FOR OPERATING SAME

CROSS-REFERENCE TO RELATED APPLICATIONS

This application claims priority under 35USC§119(e) of U.S. provisional patent application 61/808,826 filed on Apr. 5, 2013, the specification of which is hereby incorporated by reference.

TECHNICAL FIELD OF THE INVENTION

The technical field relates to $CO_2$ cooling systems and to a method for operating a $CO_2$ cooling system. More particularly, the invention relates to $CO_2$ refrigeration and air-conditioning systems.

BACKGROUND

In the last few years, carbon dioxide ($CO_2$) made a comeback in refrigeration applications where it is used as a refrigerant fluid or coolant. This is mainly due to the concerns regarding the effects of refrigerants on ozone layer depletion and global warming. $CO_2$ is known as a naturally available, safe, environmental friendly refrigerant with good thermophysical and transport properties.

In cooling systems, most of the energy costs come from the motors that drive compressors, fans, and pumps. There is thus a need to reduce the energy consumption in cooling systems while using $CO_2$ as an environmental friendly refrigerant.

BRIEF SUMMARY OF THE INVENTION

It is therefore an aim of the present invention to address the above mentioned issues.

According to a general aspect, there is provided a $CO_2$ cooling system comprising: a compression stage in which $CO_2$ refrigerant is compressed; a cooling stage in which the $CO_2$ refrigerant releases heat; and an evaporation stage in which $CO_2$ refrigerant, having released heat in the cooling stage, absorbs heat, the $CO_2$ refrigerant exiting the evaporation stage being selectively directed to one of the compression stage, before being directed to the cooling stage, and the cooling stage by-passing the compression stage.

According to another general aspect, there is provided a method for operating a $CO_2$ cooling system comprising a compression stage in which $CO_2$ refrigerant is compressed; a cooling stage in which the $CO_2$ refrigerant releases heat; and an evaporation stage in which $CO_2$ refrigerant, having released heat in the cooling stage, absorbs heat. The method comprises: circulating the $CO_2$ refrigerant in a normal operation closed-loop circuit between the compression stage, the cooling stage, and the evaporation stage; measuring an ambient temperature; comparing the measured ambient temperature to a temperature set-point; if the measured ambient temperature is below the temperature set-point, circulating the $CO_2$ refrigerant in a TFC operation closed-loop circuit between the cooling stage and the evaporation stage; otherwise, circulating the $CO_2$ refrigerant in the normal operation closed-loop circuit.

In an embodiment, the ambient temperature comprises at least one of an outdoor air temperature and a temperature associated to the cooling stage.

According to still another general aspect, there is provided a method for operating a $CO_2$ cooling system comprising a compression stage in which $CO_2$ refrigerant is compressed; a cooling stage in which the $CO_2$ refrigerant releases heat; and an evaporation stage in which $CO_2$ refrigerant, having released heat in the cooling stage, absorbs heat. The method comprises: circulating the $CO_2$ refrigerant in a TFC operation closed-loop circuit between the cooling stage and the evaporation stage; measuring at least one process parameter within the TFC operation closed-loop circuit; comparing the at least one process parameter to at least one process parameter set-point; and determining if the $CO_2$ refrigerant should be circulated in a normal operation closed-loop circuit between the compression stage, the cooling stage, and the evaporation stage using a difference between the at least one process parameter to at least one process parameter set-point.

In an embodiment of the method, measuring at least one process parameter comprises: measuring $CO_2$ pressure within the TFC operation closed-loop circuit; correlating the measured $CO_2$ pressure in a saturation state to a $CO_2$ temperature; comparing the $CO_2$ temperature to a temperature set-point; if the $CO_2$ temperature is above the temperature set-point, circulating the CO2 refrigerant in a normal operation closed-loop circuit between the compression stage, the cooling stage, and the evaporation stage; otherwise, circulating the $CO_2$ refrigerant in the TFC operation closed-loop circuit.

According to still another general aspect, there is provided a $CO_2$ cooling system. The $CO_2$ cooling system comprises: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat; and a plurality of pipes connecting the compression stage, the cooling stage, and the evaporation stage in which circulates the $CO_2$ refrigerant and being configured to define a normal operation closed-loop circuit in which the $CO_2$ refrigerant exiting the evaporation stage is directed to the compression stage before being directed to the cooling stage and a thermosyphon free cooling (TFC) operation closed-loop circuit in which the $CO_2$ refrigerant exiting the evaporation stage is directed to the cooling stage by at least one of gravity and natural convection.

In an embodiment, the compression stage is by-passed in the TFC operation closed-loop circuit.

In an embodiment, the system comprises at least one valve operatively mounted to at least one of the pipes and configurable for selectively directing the $CO_2$ refrigerant to one of the normal operation closed-loop circuit and the TFC operation closed-loop circuit. At least one of the at least one valve can be operatively connected to at least one of the pipes of the TFC operation closed-loop circuit directing the $CO_2$ refrigerant to the cooling stage.

In an embodiment, the $CO_2$ cooling system further comprises a controller operatively connected to at least one compressor of the compression stage, the controller selectively turning off the at least one compressor to direct the $CO_2$ refrigerant to the TFC operation closed-loop circuit, and powering on the at least one compressor to direct the $CO_2$ refrigerant to the normal operation closed-loop circuit.

In an embodiment, the $CO_2$ cooling system further comprises at least one $CO_2$ reservoir wherein at least part of the $CO_2$ refrigerant exiting the cooling stage is directed to at least one of the at least one $CO_2$ reservoir and at least part of the $CO_2$ refrigerant exiting the at least one $CO_2$ reservoir being directed to the evaporation stage.

In an embodiment, the $CO_2$ cooling system further comprises at least one $CO_2$ reservoir, at least part of the $CO_2$ refrigerant exiting at least one of the at least one $CO_2$ reservoir being directed to one of the compression stage in the normal operation closed-loop circuit and the cooling stage in the TFC operation closed-loop circuit.

In an embodiment, the $CO_2$ cooling system further comprises at least one pressure regulation unit operatively connected to at least one of the pipes downstream of the cooling stage and configurable to maintain a pressure differential between the cooling stage and at least one of a $CO_2$ reservoir and the evaporation stage.

In an embodiment, the TFC operation closed-loop circuit further comprises a pump operatively connected to at least one of the pipes, downstream of the cooling stage, directing $CO_2$ refrigerant exiting the cooling stage to the evaporation stage.

In an embodiment, at least one of the pipes directing $CO_2$ refrigerant exiting one of the evaporation stage and a $CO_2$ reservoir to the cooling stage is free of pump and compressor.

According to a further general aspect, there is provided a method for operating a $CO_2$ cooling system comprising a compression stage in which $CO_2$ refrigerant is compressed; a cooling stage in which the $CO_2$ refrigerant releases heat; and an evaporation stage in which $CO_2$ refrigerant, having released heat in the cooling stage, absorbs heat. The method comprises: circulating the $CO_2$ refrigerant in a normal operation closed-loop circuit between the compression stage, the cooling stage, and the evaporation stage; measuring an ambient temperature; comparing the measured ambient temperature to a temperature set-point; if the measured ambient temperature is below the temperature set-point, circulating the $CO_2$ refrigerant in a thermosyphon free cooling (TFC) operation closed-loop circuit between the cooling stage and the evaporation stage wherein the $CO_2$ refrigerant exiting the evaporation stage is directed to the cooling stage by at least one of gravity and natural convection; otherwise, circulating the $CO_2$ refrigerant in the normal operation closed-loop circuit.

In an embodiment, the compression stage comprises at least one compressor and the method further comprises turning off the at least one compressor of the compression stage when the $CO_2$ cooling system operates in the TFC operation closed-loop circuit and powering on the at least one compressor of the compression stage when the $CO_2$ cooling system operates in the normal operation closed-loop circuit.

In an embodiment, circulating the $CO_2$ refrigerant in the TFC operation closed-loop circuit comprises by-passing the compression stage.

The method as claimed in claim 10 [any one of claims 10 to 12], wherein measuring an ambient temperature comprises at least one of measuring an outdoor air temperature and measuring a temperature associated to the cooling stage.

In an embodiment, the $CO_2$ refrigerant releasing heat in the cooling stage in the normal operation closed-loop circuit is compressed. The method further comprises maintaining a pressure-differential between the $CO_2$ refrigerant exiting the cooling stage and the $CO_2$ refrigerant circulating in the evaporation stage when the $CO_2$ cooling system operates in the normal operation closed-loop circuit.

In an embodiment, the $CO_2$ cooling system further comprises at least one $CO_2$ reservoir mounted in a line extending between the evaporation stage and the cooling stage. The method further comprises directing at least part of the $CO_2$ refrigerant exiting the cooling stage to at least one of the at least one $CO_2$ reservoir. The method can further comprise directing the $CO_2$ refrigerant exiting the evaporation stage to at least one of the at least one $CO_2$ reservoir.

In an embodiment, the method further comprises pumping the $CO_2$ refrigerant exiting the cooling stage towards the evaporation stage in the TFC operation closed-loop circuit.

In an embodiment, the method further comprises directing the $CO_2$ refrigerant exiting the cooling stage to the evaporation stage by gravity in the TFC operation closed-loop circuit.

In an embodiment, the $CO_2$ refrigerant is directed to the cooling stage by at least one of gravity and natural convection in the TFC operation closed-loop circuit.

In an embodiment, the method further comprises preventing the $CO_2$ refrigerant to flow towards the compression stage when operating in the TFC operation closed-loop circuit.

In an embodiment, the method further comprises preventing the $CO_2$ refrigerant to by-pass the compression stage when operating in the normal operation closed-loop circuit.

According to a further general aspect, there is provided a method for operating a $CO_2$ cooling system comprising a compression stage in which $CO_2$ refrigerant is compressed; a cooling stage in which the $CO_2$ refrigerant releases heat; and an evaporation stage in which $CO_2$ refrigerant, having released heat in the cooling stage, absorbs heat. The method comprises: circulating the $CO_2$ refrigerant in a thermosyphon free cooling (TFC) operation closed-loop circuit between the cooling stage and the evaporation stage wherein the $CO_2$ refrigerant exiting the evaporation stage is directed to the cooling stage by at least one of gravity and natural convection; measuring at least one process parameter within the TFC operation closed-loop circuit; comparing the at least one process parameter to at least one process parameter set-point; and if the at least one process parameter is below the at least one process parameter set-point, circulating the $CO_2$ refrigerant in one of the TFC operation closed-loop circuit and a normal operation closed-loop circuit between the compression stage, the cooling stage, and the evaporation stage; otherwise, circulating the $CO_2$ refrigerant in the other one of the TFC operation closed-loop circuit and the normal operation closed-loop circuit.

In an embodiment, measuring at least one process parameter comprises: measuring $CO_2$ pressure within the TFC operation closed-loop circuit; correlating the measured $CO_2$ pressure in a saturation state to a $CO_2$ temperature; comparing the $CO_2$ temperature to a temperature set-point; if the $CO_2$ temperature is above the temperature set-point, circulating the $CO_2$ refrigerant in the normal operation closed-loop circuit; otherwise, circulating the $CO_2$ refrigerant in the TFC operation closed-loop circuit.

In an embodiment, the at least one process parameter comprises at least one of a $CO_2$ refrigerant temperature, a $CO_2$ cooling circuit charge, and a $CO_2$ temperature differential.

In an embodiment, the at least one process parameter comprises a $CO_2$ temperature differential between an input and an output of the evaporation stage.

In an embodiment, the method further comprises maintaining a pressure-differential between the $CO_2$ refrigerant exiting the cooling stage and the $CO_2$ refrigerant circulating in the evaporation stage when the $CO_2$ cooling system operates in the normal operation closed-loop circuit.

In an embodiment, the compression stage comprises at least one compressor, the method further comprising turning off the at least one compressor of the compression stage when the $CO_2$ cooling system operates in the TFC operation closed-loop circuit and powering on the at least one compressor of the compression stage when the $CO_2$ cooling system operates in the normal operation closed-loop circuit.

In an embodiment, in the TFC operation closed-loop circuit, the $CO_2$ refrigerant circulates between the cooling stage and the evaporation stage by-passing the compression stage.

In an embodiment, the $CO_2$ cooling system further comprises at least one $CO_2$ reservoir mounted in a line extending between the evaporation stage and the cooling stage, the method further comprises directing at least part of the $CO_2$ refrigerant exiting the cooling stage to at least one of the at least one $CO_2$ reservoir.

In an embodiment, the method further comprises directing the $CO_2$ refrigerant exiting the evaporation stage to at least one of the at least one $CO_2$ reservoir.

In an embodiment, the method further comprises pumping the $CO_2$ refrigerant exiting the cooling stage towards the evaporation stage in the TFC operation closed-loop circuit.

In an embodiment, the method further comprises directing the $CO_2$ refrigerant exiting the cooling stage to the evaporation stage by gravity in the TFC operation closed-loop circuit.

In an embodiment, the $CO_2$ refrigerant is directed to the cooling stage by at least one of gravity and natural convection in the TFC operation closed-loop circuit.

In an embodiment, the method further comprises preventing the $CO_2$ refrigerant to flow towards the compression stage when operating in the TFC operation closed-loop circuit.

In an embodiment, the method further comprises preventing the $CO_2$ refrigerant to by-pass the compression stage when operating in the normal operation closed-loop circuit.

According to a further general aspect, there is provided a $CO_2$ cooling system comprising: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat; and a plurality of pipes connecting the compression stage, the cooling stage, and the evaporation stage in which circulates the $CO_2$ refrigerant and being configured to define a normal operation closed-loop circuit in which the $CO_2$ refrigerant exiting the evaporation stage is directed to the compression stage before being directed to the cooling stage and a free cooling (FC) operation closed-loop circuit in which the $CO_2$ refrigerant exiting the evaporation stage is pumped to the cooling stage.

In an embodiment, the $CO_2$ cooling system further comprises at least one pump operatively connected to at least one of the pipes for pumping the $CO_2$ refrigerant exiting the evaporation stage to the cooling stage. In an embodiment, the $CO_2$ refrigerant circulates in a liquid stage between the cooling stage and the evaporation stage in the FC operation mode.

BRIEF DESCRIPTION OF THE DRAWINGS

It will be noted that throughout the appended drawings, like features are identified by like reference numerals.

DETAILED DESCRIPTION

Figure 1:
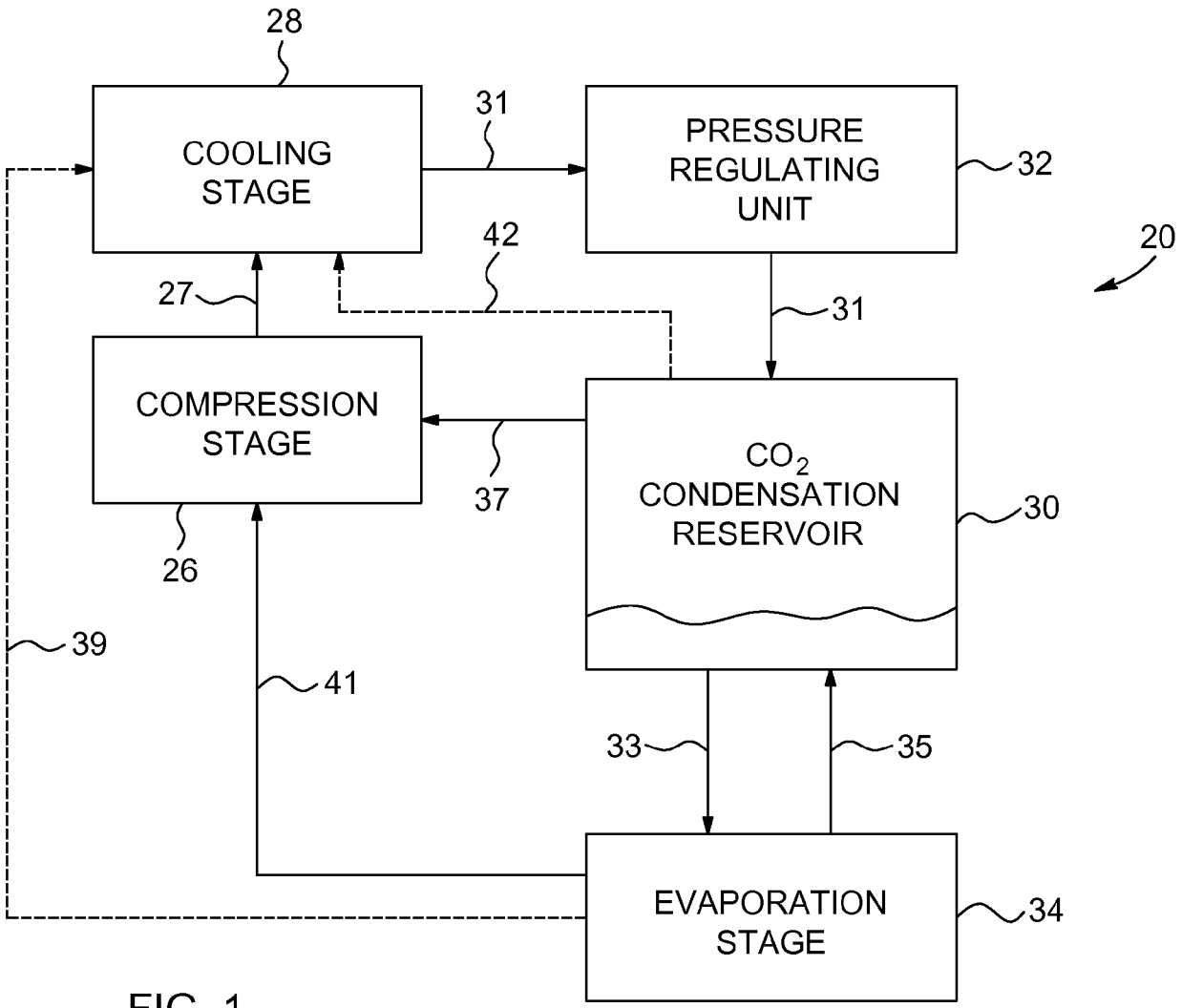
FIG. 1 is a block diagram of a $CO_2$ cooling system in accordance with a first embodiment, wherein the $CO_2$ cooling system includes a $CO_2$ condensation reservoir.

Referring now to the drawings and, more particularly, referring to FIG. 1, there is shown a $CO_2$ cooling system 20 in accordance with a first embodiment. The $CO_2$ cooling system 20 can be a $CO_2$ air-conditioning system of the type used to cool rooms such as computer server rooms. In alternative embodiments, the $CO_2$ cooling system 20 can be a refrigeration system of the type used to cool ice rinks including ice-playing surfaces, supermarket refrigerators and freezers, refrigerated rooms, and the like.

The $CO_2$ cooling system 20 is designed to operate selectively in two operation modes: a normal operation mode (or cooling mode) and a thermosyphon (or thermosiphon) free cooling (TFC) operation mode. In the normal operation mode, the $CO_2$ refrigerant circulates in a normal operation circuit in the lines (or pipes) through the action of a compression stage, as will be described in more details below, while in the TFC operation mode, the $CO_2$ refrigerant circulates in a TFC operation circuit in the lines (or pipes) without being compressed in the compression stage. In the TFC operation mode, a passive heat exchange occurs based on natural convection or gravity wherein $CO_2$ refrigerant circulates without necessity of a compression stage. In other words, in the TFC operation mode, the compressor(s) of the compression stage is (are) turned off, as will be described in more details below.

The $CO_2$ cooling system 20 comprises a compression stage 26 in which $CO_2$ refrigerant in a gaseous state is compressed in the normal operation mode. The compression stage 26 is part of the normal operation circuit. In an embodiment, the compression stage 26 includes one or several suitable compressors. If the compression stage 26 includes a plurality of compressors, they can be configured in a parallel configuration, wherein the incoming $CO_2$ refrigerant flow is divided before being supplied to the compressors and recombined following the compressor outputs. In an embodiment, the compression stage 26 can include one or more compression units, each including one or more compressors, configured in a parallel configuration. The compression units can be characterized by different operation set-points. The compression units can be fed with different $CO_2$ refrigerant flow. For instance and without being limitative, a first one of the compression units can be fed with $CO_2$ refrigerant exiting an evaporation stage, a second one of the compression units can be fed with $CO_2$ refrigerant exiting a $CO_2$ reservoir, such as a $CO_2$ condensation reservoir, and a third one of the compression units can be fed with $CO_2$ refrigerant exiting a pressure-regulation unit. The compression stage 26 is designed to compress $CO_2$ refrigerant into a sub-critical state or a super-critical state (or transcritical state), when the system 20 is operating in a normal operation mode, as will be described in more details below.

In the normal operation mode, the $CO_2$ refrigerant exiting the compression stage 26 is transferred to a cooling stage 28 in line 27. In the cooling stage 28, $CO_2$ refrigerant in a compressed state releases heat. The cooling stage is part of both the normal operation circuit and the TFC operation circuit. In an embodiment, the cooling stage 28 comprises a gas cooling stage (or gas cooler). The cooling stage 28 can include one or several cooling units which can be disposed in parallel and/or in series. For instance, in addition to or in replacement of the gas cooling stage, the cooling stage 28 can include a heat reclaim stage wherein heat is reclaimed from $CO_2$ refrigerant by heating a fluid, such as air, water, or a refrigerant, or by heating equipment. The cooling stage 28 can include one or several heating units. Valve(s) can be provided in relation with the cooling stage units to control the amount of $CO_2$ refrigerant directed to each of the cooling stage unit, such as the heating units.

The $CO_2$ refrigerant exiting the cooling stage 28 is transferred towards a $CO_2$ condensation reservoir 30 in line 31. The condensation reservoir 30 is part of both the normal operation circuit and the TFC operation circuit. A pressure differential unit 32 is positioned downstream of the cooling stage 28 and upstream of the condensation reservoir 30. In the embodiment shown, the pressure differential unit 32 divides line 31 into two sections. However, in an alternative embodiment, the pressure differential unit 32 can be mounted adjacent to one of the cooling stage 28 and the condensation reservoir 30 and line 31 can extend between the pressure differential unit 32 and the other one of the cooling stage 28 and the condensation reservoir 30. The pressure differential unit 32 can be any suitable valve or arrangement of valves that maintains a pressure differential in line 31, i.e. that maintains a higher pressure upstream thereof (i.e. the higher pressure side) than downstream thereof (i.e. the lower pressure side). The $CO_2$ refrigerant is returned to the condensation reservoir 30 in a mixture of liquid and gaseous states, when the $CO_2$ refrigerant is compressed to a supercritical state.

In an embodiment wherein the cooling system 20 is not designed to compress the $CO_2$ refrigerant in a supercritical state, the cooling system 20 can be free of pressure differential unit 32 in line 31.

When operating in the TFC operation mode, if the $CO_2$ refrigerant flows through the pressure differential unit 32, the pressure differential unit 32 is configured in an open configuration to reduce pressure losses therein. In an alternative embodiment, in the TFC operation mode, the pressure differential unit 32 can be by-passed.

The $CO_2$ condensation reservoir 30 accumulates $CO_2$ refrigerant in a combination of liquid and gaseous states. Line 33 directs $CO_2$ refrigerant from the condensation reservoir 30 to an evaporation stage 34. Line 33 can include a pump and/or expansion valve(s) and/or any other suitable pressure regulator(s). In a non-limitative embodiment, line 33 extends from the condensation reservoir 30 to direct $CO_2$ refrigerant in liquid state towards the evaporation stage 34. The evaporation stage 34 is part of both the normal operation circuit and the TFC operation circuit.

The evaporation stage 34 may comprise one or several heat exchanger(s), such as a closed circuit of pipes, in which the $CO_2$ refrigerant circulates to absorb heat from ambient air, from another fluid or from a solid. If $CO_2$ refrigerant absorbs heat from ambient air, air can be propelled on the circuit of pipes through a fan, for instance, to increase heat transfer (i.e. forced air convection).

In an embodiment, $CO_2$ refrigerant exiting the evaporation stage 34 is returned to the condensation reservoir 30, by way of line 35. $CO_2$ refrigerant, in gaseous state, is directed from the condensation reservoir 30 to the compression stage 26. In an embodiment, in the normal operation mode, $CO_2$ refrigerant is directed in line 37 extending from the condensation reservoir 30 to the compression stage 26. In another embodiment, when operating in the normal operation mode, $CO_2$ refrigerant exiting the evaporation stage 34 can also be directed to the compression stage 26, by way of line 41, thereby by-passing the $CO_2$ condensation reservoir 30.

As mentioned above, the $CO_2$ cooling system 20 is designed to operate selectively in two operation modes: the normal operation mode and the TFC operation mode. In the normal operation mode, the $CO_2$ refrigerant circulates in the lines through the action of the compression stage 26, amongst others. In the TFC operation mode, the compressor(s) of the compression stage 26 is (are) turned off. In an embodiment, the $CO_2$ refrigerant is transferred from the evaporation stage 34 to the cooling stage 28 in line 39 by natural convection or gravity. In another embodiment, the $CO_2$ refrigerant is transferred from the condensation reservoir 30 to the cooling stage 28 in line 42 also by natural convection or gravity. Line 42 extends from the condensation reservoir 30 to the cooling stage 28. Valve(s) or other suitable device(s) can be provided in lines 27, 39, and 42 to prevent $CO_2$ refrigerant to be directed towards the compression stage 26 when the $CO_2$ cooling system 20 operates in TFC operation mode and to prevent $CO_2$ refrigerant to be directed directly towards the cooling stage 28 from the evaporation stage 34 and/or the condensation reservoir 30 when the $CO_2$ cooling system 20 operates in normal operation mode. Valve(s) or other suitable device(s) can be solenoid valves, motorized valves, one-way flow control device(s) to allow $CO_2$ refrigerant circulation in only one flow direction within a line (or a pipe), pressure-regulating valves, and the like.

Thus, in the TFC operation mode, the compressor(s) of compression stage 26 is (are) turned off, thereby reducing the energy consumption of the $CO_2$ cooling system 20. The $CO_2$ refrigerant exiting the evaporation stage 34 or the condensation reservoir 30 in gaseous state is directed towards the cooling stage 28 in line 39 or line 42 by natural convection or gravity. In the cooling stage 28, the $CO_2$ refrigerant in gaseous state releases heat and at least partially condenses. The $CO_2$ refrigerant exiting the cooling stage 28 is directed towards the condensation reservoir 30 in line 31. When returning the $CO_2$ refrigerant exiting the cooling stage 28 to the condensation reservoir 30, the pressure differential unit 32 can be either by-passed or configured in an open configuration to reduce pressure losses therein. In an embodiment, the $CO_2$ refrigerant exiting the cooling stage 28 flows in line 31 towards the condensation reservoir 30 by gravity. In an alternative embodiment, line 31 can include a pump to induce a $CO_2$ refrigerant flow therein. The $CO_2$ refrigerant contained in the condensation reservoir 30 in liquid state is directed towards the evaporation stage 34 to absorb heat and at least partially evaporates therein.

In the normal operation mode, the compressors of the compression stage 26 are powered on and the $CO_2$ refrigerant exiting the evaporation stage 34 is directed towards the condensation reservoir 30 and, then, transferred to the compression stage 26 where it is compressed before being transferred to the cooling stage 28 to release heat. In an alternative embodiment, as mentioned above, the $CO_2$ refrigerant is directed directly from the evaporation stage 34 to compression stage 26 in line 41 to be compressed.

To control the $CO_2$ cooling system 20 to operate in the normal operation mode or the TFC operation mode, the compression stage 26 and, optionally, selected valve(s) can be operatively connected to a controller (not shown). Based on a temperature measurement, such as the outdoor air temperature, and/or a pressure measurement, and a corresponding one of a temperature or pressure set-point, a decision is taken regarding the operation mode of the $CO_2$ cooling system 20. More particularly, for instance, if the outdoor air temperature is below or equal to a temperature set-point, the $CO_2$ cooling system 20 is configured to operate in the TFC operation mode. On the opposite, if the outdoor air temperature is above the temperature set-point, the $CO_2$ cooling system 20 is configured to operate in the normal operation mode. In a non-limitative embodiment, the temperature set-point is equal or slightly below the temperature set-point of the evaporation stage 34. In alternative embodiments, the temperature measurement, such as the ambient temperature, can be a temperature measurement associated to the cooling stage such as the temperature of a secondary fluid, such as air or another refrigerant, or a solid.

The controller is also operatively connected to the compressor(s) of the compression stage 26. The controller is configured to selectively turn off the compressor(s) to direct the $CO_2$ refrigerant from the evaporation stage 34 to the cooling stage 28, without compressing $CO_2$ refrigerant, when the $CO_2$ cooling system 20 operates in the TFC operation mode, and to power on the compressor(s) to direct the $CO_2$ refrigerant from the evaporation stage 34 to the cooling stage 28 through the compression stage 26, when the $CO_2$ cooling system 20 operates in the normal operation mode.

In an embodiment (not shown), the cooling stage 28 can include two or more independent $CO_2$ cooling circuits. For instance, in a first cooling circuit, $CO_2$ refrigerant can circulate between the cooling stage 28 and the evaporation stage 34 or the $CO_2$ condensation reservoir 30, by passing the compression stage 26. The first cooling circuit is thus configured for operating in the TFC operation mode. In a second cooling circuit, $CO_2$ refrigerant can circulate between the cooling stage 28 and the evaporation stage 34 or the $CO_2$ condensation reservoir 30 through the compression stage 26. The second cooling circuit is thus configured for operating in the normal operation mode. The $CO_2$ cooling circulating in both cooling circuits is separated in the cooling stage 28 but is mixed in the $CO_2$ condensation reservoir 30 and the evaporation stage 34. Thus, the cooling stage 28 comprises two distinct and separate $CO_2$ flows: $CO_2$ circulating in a first one of the $CO_2$ circuits in the TFC operation mode and in a second one of the circuits in the normal operation mode.

In an embodiment, $CO_2$ refrigerant could be prevented to circulate in lines 39 and/or 42 in the normal operation mode by closing suitable valve(s). Similarly, in an embodiment, $CO_2$ refrigerant could be prevented to circulate in lines 27, 37, and/or 41 in the TFC operation mode by closing suitable valve(s). However, in an embodiment, one or several lines can remain open. For instance, if the cooling stage 28 includes two independent cooling circuits, lines 39 and/or 42 can remain open when operating in the normal operation mode. Alternatively, lines 39 and/or 42 can be configured to allow $CO_2$ refrigerant in only one direction from either the $CO_2$ reservoir 30 or the evaporation stage 34 towards the cooling stage 28 and prevent $CO_2$ refrigerant circulation in the opposite direction, i.e. from the cooling stage towards either the $CO_2$ reservoir 30 or the evaporation stage 34. Similarly, lines 27, 37, and/or 41 can remain open or allow $CO_2$ refrigerant circulation in only one direction when operating in the TFC operation mode. However, the compressors of the compression stage 26 being turned off, the $CO_2$ flow within these lines would be limited.

The term "by-pass" is used herein as the compression stage 26 is mainly by-passed when operating in the TFC operation mode, i.e. that the $CO_2$ refrigerant is not compress by the compression stage 26 when circulating between either the $CO_2$ reservoir 30 and the evaporation stage 34 and the cooling stage 28 since the compressor(s) of the compression stage 26 is(are) turned off. In an embodiment, the lines (or pipes) can be closed to prevent $CO_2$ refrigerant to flow towards and/or through the compression stage 26. In an embodiment, the lines or conduits remain open but since the compressor(s) of the compression stage 26 is(are) turned off, the $CO_2$ refrigerant flow therein occurs through convection or gravity.

Figure 2:
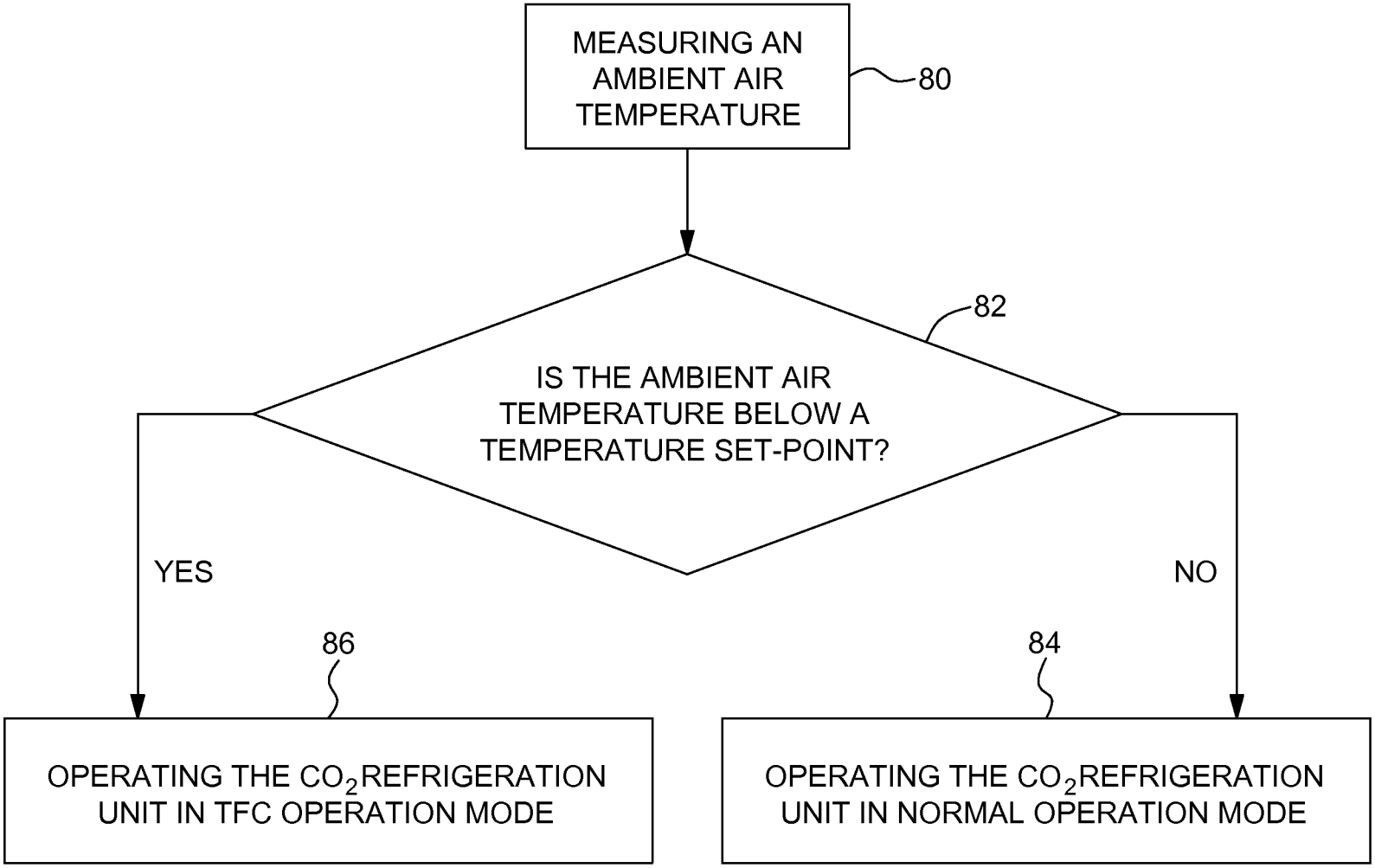
FIG. 2 is a flowchart representing a method for operating the $CO_2$ cooling system.

Referring to FIG. 2, there is shown that, in accordance with an embodiment, to determine whether the $CO_2$ cooling system 20, which operates in the normal operation mode, should operate in the TFC operation mode, an ambient air temperature is measured in step 80. The ambient air temperature can be the outdoor air temperature or temperature measurement(s) associated to the cooling stage such as the temperature of a secondary fluid, such as air or another refrigerant, or a solid. If the measured ambient air temperature is below a temperature set-point, the $CO_2$ cooling system 20 is operated in TFC operation mode (step 86). Otherwise, the $CO_2$ cooling system 20 continues its operation in the normal operation mode (step 84). The temperature set point can be determined based on field experiments.

In an embodiment, to determine whether the $CO_2$ cooling system 20, which operates in the TFC operation mode, should operate in the normal operation mode, an ambient air temperature, such as the outdoor air temperature, is measured in step 80. If the measured ambient air temperature is below a temperature set-point, the $CO_2$ cooling system 20 continues to operate in TFC operation mode (step 86). Otherwise, the $CO_2$ cooling system 20 is then operated in the normal operation mode (step 84). The temperature set-point to determine if the system 20, operating in the TFC operation mode, should operate in the normal operation mode can be identical to or different from the temperature set-point to determine if the system 20, operating in the normal operation mode, should operate in the TFC operation mode.

In an alternative embodiment, to determine whether the $CO_2$ cooling system 20, which operates in the TFC operation mode, should operate in the normal operation mode, a pressure within the system 20 is measured. Since the system 20 operates in saturation conditions, the measured pressure can be correlated to a temperature with a pressure/temperature table in saturation conditions. The temperature, which corresponds to the measured pressure, is compared to temperature set-point. If the temperature is below the temperature set-point, the system 20 continues its operation in the TFC operation mode. Otherwise, the system 20 is then operated in the normal operation mode. In alternative embodiments, instead of measuring a pressure within the system 20, a temperature differential, a pressure differential or a system load can be measured. For instance and without being limitative, the criterion to determine if the system 20 should operate in the TFC or the normal operation mode can be based on the temperature differential between the evaporation stage input and output, either the temperature of the secondary fluid in heat exchange with $CO_2$ refrigerant or the $CO_2$ refrigerant temperature. For instance, if the temperature differential between the evaporation stage input and output is below a predetermined temperature differential threshold, the $CO_2$ cooling system 20 operates in normal operation mode. Otherwise, the $CO_2$ cooling system 20 operates in TFC operation mode.

The set-points are selected to ensure a $CO_2$ flow within the $CO_2$ cooling system when operating in the TFC operation mode. If the $CO_2$ flow within the $CO_2$ cooling system is insufficient, the $CO_2$ cooling system is then operated in the normal operation mode.

In the normal operation mode, the $CO_2$ refrigerant pressure in the gas cooling stage 28 is higher than in the evaporation stage 34. Therefore, $CO_2$ refrigerant flows from the gas cooling stage 28 towards the evaporation stage 34, through the $CO_2$ reservoir, if any. However, in TFC operation mode, the $CO_2$ refrigerant pressure in the gas cooling stage 28 is slightly lower or equal to the $CO_2$ refrigerant pressure than in the evaporation stage 34. Therefore, $CO_2$ refrigerant is drawn from the evaporation stage 34 or the $CO_2$ reservoir towards the cooling stage 28 naturally by convection and the $CO_2$ refrigerant returns to the evaporation stage 34 by gravity or pumping power. As mentioned above, line 31 can include one or several pump(s).

As mentioned above, the $CO_2$ cooling system 20 can operate in the normal and TFC operation modes. In the normal operation mode, the $CO_2$ refrigerant is compressed either to a sub-critical state or a supercritical state. In the TFC operation mode, the $CO_2$ refrigerant is in a sub-critical state and, more particularly, uncompressed by compressor(s) of the compression stage 26.

In the normal operation mode, $CO_2$ refrigerant can be prevented from circulating in line 39 extending between the evaporation stage 34 and the cooling stage 28. In an embodiment, in the TFC operation mode, $CO_2$ refrigerant circulates in the lines or pipes mainly through gravity and convection since the compressor(s) of the compression stage 26 are turned off. In an embodiment, in the TFC operation mode, $CO_2$ refrigerant is prevented from being directed towards the compression stage 26. Valve(s) can be provided in suitable lines to configure the $CO_2$ refrigerant system in the selected configuration and to control the $CO_2$ refrigerant circulation therein.

Figure 3:
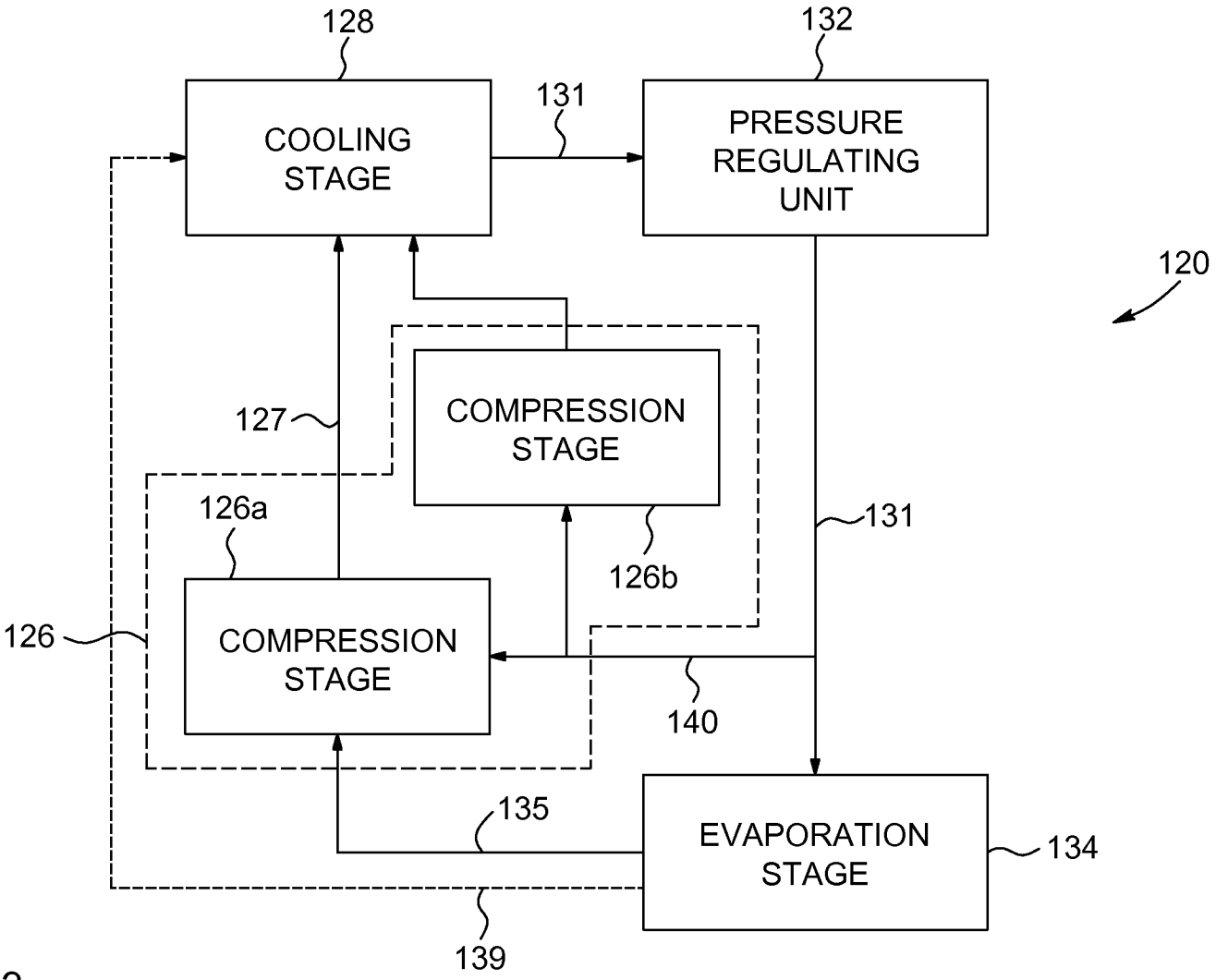
FIG. 3 is a block diagram of a $CO_2$ cooling system in accordance with a second embodiment, wherein the $CO_2$ cooling system is free of $CO_2$ condensation reservoir.

Referring now to FIG. 3, there is shown an alternative embodiment of a $CO_2$ cooling system wherein the features are numbered with reference numerals in the 100 series which correspond to the reference numerals of the previous embodiment. In the embodiment shown in FIG. 3, the $CO_2$ cooling system 120 is free of $CO_2$ reservoir 30. Thus, the $CO_2$ refrigerant exiting the evaporation stage 134 is directed directly to the compression stage 126 in the normal operation mode and to the cooling stage 128 in the TFC operation mode. Similarly, $CO_2$ exiting the cooling stage 128 is directed to the evaporation stage 134 in both the normal and TFC operation modes.

The compression stage 126 of the $CO_2$ cooling system 120 comprises two compression units 126*a*, 126*b* in which $CO_2$ refrigerant in a gaseous state is compressed when the $CO_2$ cooling system 120 operates in the normal operation mode. In alternative embodiments, the compression stage 126 can include one or more compression unit(s). In the normal operation mode, the $CO_2$ refrigerant exiting the compression stage 126 is transferred to the cooling stage 128 in line 127. In the cooling stage 128, $CO_2$ refrigerant releases heat. The $CO_2$ refrigerant exiting the cooling stage 128 is transferred to the evaporation stage 134 in line 131. A flash gas portion of the $CO_2$ refrigerant exiting the pressure differential unit 132 can be directed towards the compression stage 126 via line 140. The pressure differential unit 132 is positioned downstream of the cooling stage 128 and upstream of the evaporation stage 134. In an alternative embodiment, the $CO_2$ cooling system 120 can be free of pressure differential unit 132 if operated in a subcritical state. The $CO_2$ refrigerant exiting the evaporation stage 134 is directed to the compression stage unit 126*a*, by way of line 135, when the $CO_2$ cooling system 120 operates in the normal operation mode and to the cooling stage 128, by way of line 139, when the $CO_2$ cooling system 120 operates in the TFC operation mode. In an embodiment, $CO_2$ refrigerant exits from the evaporation stage 134 mainly in the gaseous state.

As for the $CO_2$ cooling system 20, in the normal operation mode, the $CO_2$ refrigerant circulates in the $CO_2$ cooling system 120 mainly through the action of the compression stage 126. In the TFC operation mode, the compressor(s) of the compression stage 126 are turned off and the $CO_2$ refrigerant is transferred from the evaporation stage 134 to the cooling stage 128 in line 139 by natural convection or gravity. Valve(s) or other suitable device(s) can be provided in lines 127 and 139 to control $CO_2$ flow or prevent $CO_2$ refrigerant to be directed towards the compression stage 126 when the $CO_2$ cooling system 120 operates in TFC operation mode and to control $CO_2$ flow or prevent $CO_2$ refrigerant to be directed directly towards the cooling stage 128 when the $CO_2$ cooling system 120 operates in normal operation mode.

Figure 4:
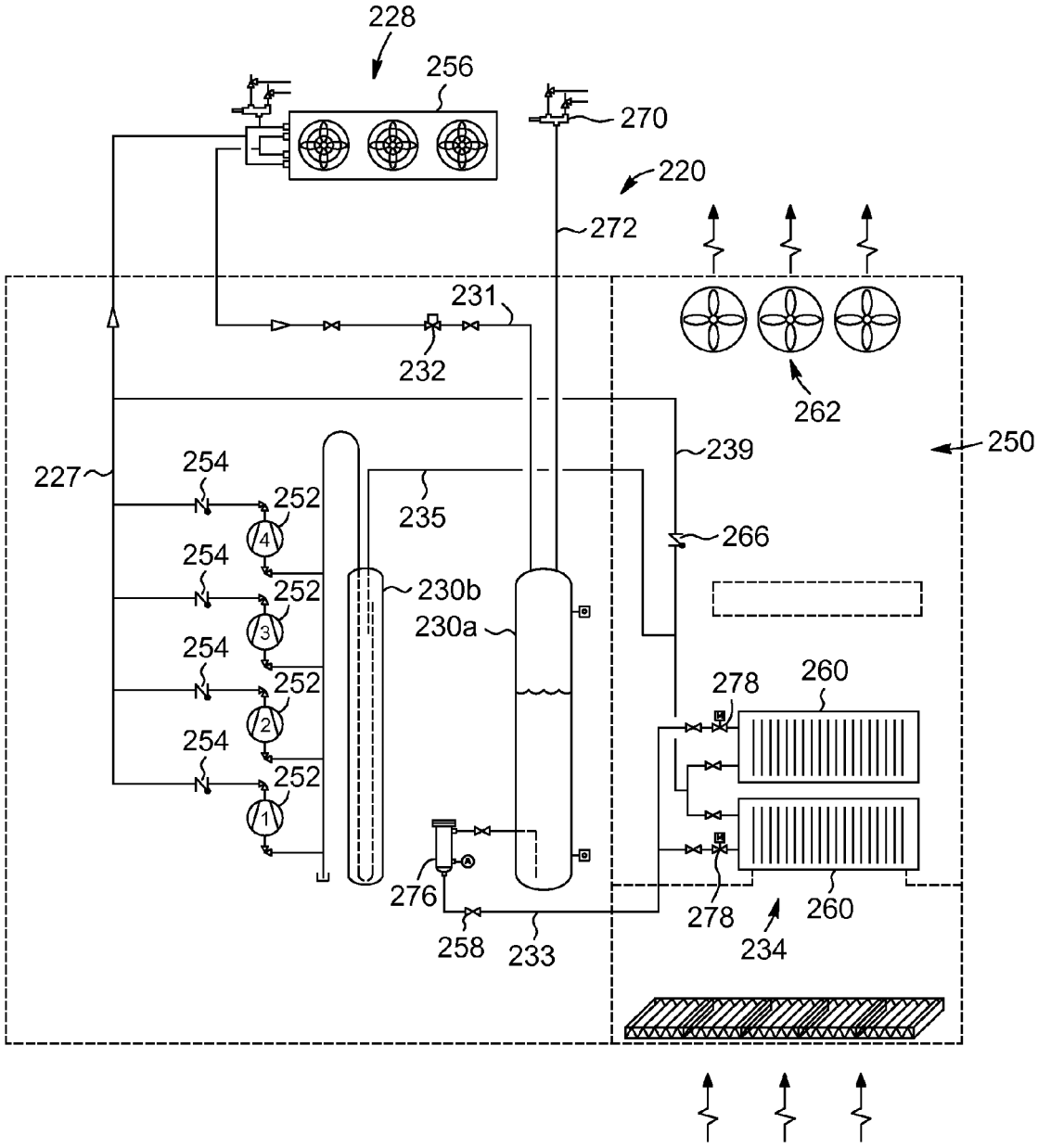
FIG. 4 is a technical plan of a $CO_2$ cooling system in accordance with a third embodiment, wherein the $CO_2$ cooling system is designed to cool down a room.

Referring now to FIG. 4, there is shown an alternative embodiment of a $CO_2$ cooling system wherein the features are numbered with reference numerals in the 200 series which correspond to the reference numerals of the previous embodiments. In the embodiment shown in FIG. 4, the $CO_2$ cooling system 220 comprises two $CO_2$ reservoirs 230*a*, 230*b*. The reservoir 230*a* is a $CO_2$ condensation reservoir while the reservoir 230*b* is a suction accumulator. The condensation reservoir 230*a* accumulates $CO_2$ refrigerant in liquid and gaseous states. The suction accumulator provides storage for the $CO_2$ refrigerant directed to the compression stage 226 from the evaporation stage 234 and in which separation of the $CO_2$ refrigerant in gaseous state from the $CO_2$ refrigerant in liquid state occurs.

In the embodiment shown, the $CO_2$ cooling system 220 is conceived to cool down a room and, more particularly, for instance, a computer server room 250. The evaporation stage 234 is located inside the room 250. Other configurations and applications can be foreseen.

The $CO_2$ cooling system 220 comprises a compression stage 226 in which $CO_2$ refrigerant in a gaseous state is compressed by a plurality of compressors 252 mounted in parallel. The compressors 252 are designed to compress $CO_2$ refrigerant and can compress $CO_2$ refrigerant into a subcritical state or a supercritical state (or transcritical state), when the $CO_2$ cooling system is configured in the normal operation mode.

In the normal operation mode, the $CO_2$ refrigerant exiting the compression stage 226 is transferred to a cooling stage 228 in line 227. Check valves 254 are mounted in the line(s) extending between the output of the compression stage 226 and the cooling stage 228, the purpose of which will be described in more details below. In the cooling stage 228, $CO_2$ refrigerant releases heat. In the normal operation mode, $CO_2$ refrigerant directed to the cooling stage 228 is compressed $CO_2$ refrigerant. In the embodiment shown in FIG. 4, the cooling stage 228 comprises a gas cooler 256. The $CO_2$ refrigerant exiting the cooling stage 228 is transferred to the $CO_2$ condensation reservoir 230*a* in line 231. A pressure differential unit 232 is positioned downstream of the cooling stage 228 and upstream of the $CO_2$ condensation reservoir 230*a*. The purpose of the pressure differential unit 232 is the same as the purposes of the pressure differential unit 32, 132 described above.

Line 233 directs $CO_2$ refrigerant, in liquid state, from the condensation reservoir 230*a* to the evaporation stage 234. Line 233 includes an expansion valve 258. In the embodiment shown in FIG. 4, the evaporation stage 234 comprises two heat exchangers and, in the embodiment shown, two closed circuits of pipes 260, configured in parallel, in which the $CO_2$ refrigerant circulates to absorb heat from ambient air contained in the room 250 to cool down. A plurality of fans 262 is provided to promote air circulation in the room 250. The air is drawn in the room 250, flows around the closed circuit of pipes 260 to promote heat exchange and then exits through an aperture (not shown). Forced convection within the room 250 increases heat transfer.

$CO_2$ refrigerant exiting the evaporation stage 234 is directed to the suction accumulator 230*b*, by way of line 235 in the normal operation mode. In the TFC operation mode, $CO_2$ refrigerant exiting the evaporation stage 234 is directed to the cooling stage 228 in line 239. Line 239 includes a check valve 266, the purpose of which will be described in more details below. In the normal operation mode, $CO_2$ refrigerant is supplied to the compression stage 226 from the suction accumulator 230*b* in line 227. In an embodiment, $CO_2$ refrigerant flows in line 227 extending from the suction accumulator 230*b* to the compression stage 226.

In the normal operation mode, the $CO_2$ refrigerant circulates in the $CO_2$ cooling system 220 mainly through the action of the compression stage 226. In the TFC operation mode, the compressors of the compression stage 226 are turned off and the $CO_2$ refrigerant is transferred from the evaporation stage 234 to the cooling stage 228 in line 239 by natural convection or gravity. Check-valves 254, 266 are provided in lines 227 and 239 to prevent $CO_2$ refrigerant to be directed towards the compression stage 226 when the $CO_2$ cooling system 220 operates in the TFC operation mode and to prevent $CO_2$ refrigerant to be directed directly towards the cooling stage 228 when the $CO_2$ cooling system 220 operates in normal operation mode. Check-valves 254, 266 are one-way valves which allow $CO_2$ refrigerant circulation in a single direction. Check-valve 254 allows $CO_2$ refrigerant circulation from the compression stage 226 towards the cooling stage 228 while check-valve 266 allows $CO_2$ refrigerant circulation from the evaporation stage 234 towards the cooling stage 228. Both check-valves 254, 266 prevent $CO_2$ refrigerant flow in the opposite direction. When operating in the TFC operation mode, the compressors 252 can be turned off and $CO_2$ refrigerant is directed from the evaporation stage 234 towards the cooling stage 228 by natural convection or gravity without being compressed by the compression stage 226. When operating in the normal operation mode, check-valve 266 is configured in the closed configuration, the compressors 252 are powered on, and $CO_2$ refrigerant is directed towards the compression stage 226.

A pressure relief valve 270 is provided in a line 272 extending from a top of the condensation reservoir 230*a*. The $CO_2$ cooling system 220 also comprises one or more oil separator 276, other valves to control the fluid flow therein, and a plurality of suitable sensors, as it is known in the art. For instance, electronic control valves 278 are provided in the lines extending between the condensation reservoir 230*a* or the cooling stage 228 to the evaporation stage 234. The electronic control valves 278 can be configured to control the $CO_2$ expansion and therefore the temperature.

In the embodiments described above, when operating in the TFC operation mode, $CO_2$ refrigerant exiting the cooling stage 228 is transferred to the condensation reservoir 230*a* by gravity. However, in an alternative embodiment, a pump (not shown) can be provided in the line 231 extending between the gas cooling stage 228 and the condensation reservoir 230*a*. The pump can be mounted either upstream or downstream of the pressure differential unit 232. As mentioned above, in an alternative embodiment, the pressure differential unit 232 can be by-passed and the pump can be mounted on the by-pass line.

In the embodiments described above, in the evaporation stage, heat transfer between $CO_2$ refrigerant and ambient air occurs directly. However, in an alternative embodiment, the heat transfer between $CO_2$ refrigerant and ambient air can occur indirectly through a transfer fluid. Furthermore, the above-described cooling systems can be used to cool down gases, liquids, and solids by heat exchange.

In an alternative embodiment, the $CO_2$ cooling system can operate in the normal operation mode and a free cooling mode. In the free cooling mode, the compressor(s) of the compression stage is(are) turned off and the $CO_2$ refrigerant circulates between the cooling stage and the evaporation stage in a liquid stage. In the evaporation stage, the $CO_2$ refrigerant absorbs heat which is released in the cooling stage. Pumps can be provided in the lines (or pipes) extending between the cooling stage and the evaporation stage to circulate $CO_2$ refrigerant therein. For instance, at least one pump can be provided in a line to direct $CO_2$ refrigerant exiting the evaporation stage to the cooling stage and at least one pump can be provided in a line to direct $CO_2$ refrigerant exiting the cooling stage to the evaporation stage. Combinations of the $CO_2$ cooling systems 20, 120, 220 can be applied to the $CO_2$ cooling system operating in FC operation mode.

Combinations of the $CO_2$ cooling systems 20, 120, 220 can be foreseen. For instance, as the cooling system 120, the $CO_2$ cooling system 220 can be free of $CO_2$ reservoir or include a single $CO_2$ reservoir. As for the $CO_2$ cooling system 120, the $CO_2$ cooling systems 20, 220 can also include two or more compression units.

It is appreciated that the cooling systems 20, 120, 220 can include several lines extending in parallel or, in some embodiments, lines can combine. For instance and without being limitative, in the cooling system 20 shown in FIG. 1, either line 27, line 39, and/or line 42 can combine before entering the cooling stage 28. In an alternative embodiment, the cooling stage 28 can include two independent refrigerant circuits for the $CO_2$ refrigerant exiting the compression stage and for the $CO_2$ refrigerant exiting the evaporation stage 34 and/or the $CO_2$ condensation reservoir 30. Similarly, in the cooling system 120 shown in FIG. 3, the $CO_2$ refrigerant exiting the compression units 126*a*, 126*b* can be combined before entering the cooling stage 128. Furthermore, the lines extending between at least one of the compression units 126*a*, 126*b* and the cooling stage 128 can also be combined with the line extending between the evaporation stage 134 and the cooling stage 128. In an alternative embodiment, the cooling stage 128 can include two independent refrigerant circuits for the $CO_2$ refrigerant exiting the compression units 126*a*, 126*b* and for the $CO_2$ refrigerant exiting the evaporation stage 134. Other by-pass lines can be provided between two or more $CO_2$ refrigerant lines.

In an embodiment, the $CO_2$ cooling system can include one $CO_2$ reservoir which can be either a $CO_2$ condensation reservoir or a suction accumulator. In an alternative embodiment, as shown in FIG. 3, the $CO_2$ cooling system can be free of $CO_2$ reservoir. In still another embodiment, the $CO_2$ cooling system can include two or more $CO_2$ reservoirs.

The cooling system described above and the associated method reduce the total energy requirement of the $CO_2$ cooling system and increase the lifetime of the compressors of the cooling stage.

It will be appreciated that the method to operate the $CO_2$ cooling system described herein may be performed in the described order, or in any other suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A $CO_2$ cooling system comprising: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat; and a plurality of pipes connecting the compression stage, the cooling stage, and the evaporation stage in which circulates the $CO_2$ refrigerant and being configured to define a normal operation closed-loop circuit in which the $CO_2$ refrigerant exiting the evaporation stage is directed to the compression stage before being directed to the cooling stage and a thermosyphon free cooling (TFC) operation closed-loop circuit in which the $CO_2$ refrigerant exiting the evaporation stage is directed to the cooling stage by at least one of gravity and natural convection; and a controller operatively connected to at least one compressor of the compression stage, the controller selectively turning off the at least one compressor to direct the $CO_2$ refrigerant to the TFC operation closed-loop circuit, and powering on the at least one compressor to direct the $CO_2$ refrigerant to the normal operation closed-loop circuit.

2. The $CO_2$ cooling system as claimed in claim 1, wherein the compression stage is by-passed in the TFC operation closed-loop circuit.

3. The $CO_2$ cooling system as claimed in claim 1, wherein the system comprises at least one valve operatively mounted to at least one of the pipes and configurable for selectively directing the $CO_2$ refrigerant to one of the normal operation closed-loop circuit and the TFC operation closed-loop circuit.

4. The $CO_2$ cooling system as claimed in claim 3, wherein at least one of the at least one valve is operatively connected to at least one of the pipes of the TFC operation closed-loop circuit directing the $CO_2$ refrigerant to the cooling stage.

5. The $CO_2$ cooling system as claimed in claim 1, further comprising at least one $CO_2$ reservoir wherein at least part of the $CO_2$ refrigerant exiting the cooling stage is directed to at least one of the at least one $CO_2$ reservoir and at least part of the $CO_2$ refrigerant exiting the at least one $CO_2$ reservoir being directed to the evaporation stage.

6. The $CO_2$ cooling system as claimed in claim 1, further comprising at least one $CO_2$ reservoir, at least part of the $CO_2$ refrigerant exiting at least one of the at least one $CO_2$ reservoir being directed to one of the compression stage in the normal operation closed-loop circuit and the cooling stage in the TFC operation closed-loop circuit.

7. The $CO_2$ cooling system as claimed in claim 1, wherein the TFC operation closed-loop circuit further comprises a pump operatively connected to at least one of the pipes, downstream of the cooling stage, directing $CO_2$ refrigerant exiting the cooling stage to the evaporation stage.

8. The $CO_2$ cooling system as claimed in claim 1, wherein at least one of the pipes directing $CO_2$ refrigerant exiting one of the evaporation stage and a $CO_2$ reservoir to the cooling stage is free of pump and compressor.

9. A method for operating a $CO_2$ cooling system comprising a compression stage in which $CO_2$ refrigerant is compressed; a cooling stage in which the $CO_2$ refrigerant releases heat; and an evaporation stage in which $CO_2$ refrigerant, having released heat in the cooling stage, absorbs heat, the method comprising: circulating the $CO_2$ refrigerant in a normal operation closed-loop circuit between the compression stage, the cooling stage, and the evaporation stage; measuring an ambient temperature; comparing the measured ambient temperature to a temperature set-point; if the measured ambient temperature is below the temperature set-point, circulating the $CO_2$ refrigerant in a thermosyphon free cooling (TFC) operation closed-loop circuit between the cooling stage and the evaporation stage wherein the $CO_2$ refrigerant exiting the evaporation stage is directed to the cooling stage by at least one of gravity and natural convection; otherwise, circulating the $CO_2$ refrigerant in the normal operation closed-loop circuit.

10. The method as claimed in claim 9, wherein the compression stage comprises at least one compressor, the method further comprising turning off the at least one compressor of the compression stage when the $CO_2$ cooling system operates in the TFC operation closed-loop circuit and powering on the at least one compressor of the compression stage when the $CO_2$ cooling system operates in the normal operation closed-loop circuit.

11. The method as claimed in claim 9, wherein circulating the $CO_2$ refrigerant in the TFC operation closed-loop circuit comprises by-passing the compression stage.

12. The method as claimed in claim 9, wherein measuring an ambient temperature comprises at least one of measuring an outdoor air temperature and measuring a temperature associated to the cooling stage.

13. The method as claimed in claim 9, wherein the $CO_2$ refrigerant releasing heat in the cooling stage in the normal operation closed-loop circuit is compressed, the method further comprising maintaining a pressure-differential between the $CO_2$ refrigerant exiting the cooling stage and the $CO_2$ refrigerant circulating in the evaporation stage when the $CO_2$ cooling system operates in the normal operation closed-loop circuit.

14. The method as claimed in claim 9, wherein the $CO_2$ cooling system further comprises at least one $CO_2$ reservoir mounted in a line extending between the evaporation stage and the cooling stage, the method further comprises directing at least part of the $CO_2$ refrigerant exiting the cooling stage to at least one of the at least one $CO_2$ reservoir and directing the $CO_2$ refrigerant exiting the evaporation stage to at least one of the at least one $CO_2$ reservoir.

15. The method as claimed in claim 9, further comprising pumping the $CO_2$ refrigerant exiting the cooling stage towards the evaporation stage in the TFC operation closed-loop circuit.

16. The method as claimed in claim 9, further comprising directing the $CO_2$ refrigerant exiting the cooling stage to the evaporation stage by gravity in the TFC operation closed-loop circuit.

17. The method as claimed in claim 9, further comprising preventing the $CO_2$ refrigerant to by-pass the compression stage when operating in the normal operation closed-loop circuit.

18. A method for operating a $CO_2$ cooling system comprising a compression stage in which $CO_2$ refrigerant is compressed; a cooling stage in which the $CO_2$ refrigerant releases heat; and an evaporation stage in which $CO_2$ refrigerant, having released heat in the cooling stage, absorbs heat, the method comprising: circulating the $CO_2$ refrigerant in a thermosyphon free cooling (TFC) operation closed-loop circuit between the cooling stage and the evaporation stage wherein the $CO_2$ refrigerant exiting the evaporation stage is directed to the cooling stage by at least one of gravity and natural convection; measuring at least one process parameter within the TFC operation closed-loop circuit; comparing the at least one process parameter to at least one process parameter set-point; and if the at least one process parameter is below the at least one process parameter set-point, circulating the $CO_2$ refrigerant in one of the TFC operation closed-loop circuit and a normal operation closed-loop circuit between the compression stage, the cooling stage, and the evaporation stage; otherwise, circulating the $CO_2$ refrigerant in the other one of the TFC operation closed-loop circuit and the normal operation closed-loop circuit.

19. The method as claimed in claim 18, wherein measuring at least one process parameter comprises: measuring $CO_2$ pressure within the TFC operation closed-loop circuit; correlating the measured $CO_2$ pressure in a saturation state to a $CO_2$ temperature; comparing the $CO_2$ temperature to a temperature set-point; if the $CO_2$ temperature is above the temperature set-point, circulating the $CO_2$ refrigerant in the normal operation closed-loop circuit; otherwise, circulating the $CO_2$ refrigerant in the TFC operation closed-loop circuit.

20. The method as claimed in claim 18, wherein the at least one process parameter comprises at least one of a $CO_2$ refrigerant temperature, a $CO_2$ cooling circuit charge, and a $CO_2$ temperature differential.

21. The method as claimed in claim 18, wherein the at least one process parameter comprises a $CO_2$ temperature differential between an input and an output of the evaporation stage.

22. The method as claimed in claim 18, wherein the compression stage comprises at least one compressor, the method further comprising turning off the at least one compressor of the compression stage when the $CO_2$ cooling system operates in the TFC operation closed-loop circuit and powering on the at least one compressor of the compression stage when the $CO_2$ cooling system operates in the normal operation closed-loop circuit.

23. The method as claimed in claim 18, wherein in the TFC operation closed-loop circuit, the $CO_2$ refrigerant circulates between the cooling stage and the evaporation stage by-passing the compression stage.

24. The method as claimed in claim 18, wherein the $CO_2$ cooling system further comprises at least one $CO_2$ reservoir mounted in a line extending between the evaporation stage and the cooling stage, the method further comprises directing at least part of the $CO_2$ refrigerant exiting the cooling stage to at least one of the at least one $CO_2$ reservoir.

25. The method as claimed in claim 24, further comprising directing the $CO_2$ refrigerant exiting the evaporation stage to at least one of the at least one $CO_2$ reservoir.

26. The method as claimed in claim 18, further comprising pumping the $CO_2$ refrigerant exiting the cooling stage towards the evaporation stage in the TFC operation closed-loop circuit.

27. The method as claimed in claim 18, further comprising directing the $CO_2$ refrigerant exiting the cooling stage to the evaporation stage by gravity in the TFC operation closed-loop circuit.

28. The method as claimed in claim 18, further comprising preventing the $CO_2$ refrigerant to flow towards the compression stage when operating in the TFC operation closed-loop circuit.

29. The method as claimed in claim 18, further comprising preventing the $CO_2$ refrigerant to by-pass the compression stage when operating in the normal operation closed-loop circuit.

30. A $CO_2$ cooling system comprising: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat; and a plurality of pipes connecting the compression stage, the cooling stage, and the evaporation stage in which circulates the $CO_2$ refrigerant and being configured to define a normal operation closed-loop circuit in which the $CO_2$ refrigerant exiting the evaporation stage is directed to the compression stage before being directed to the cooling stage and a free cooling (FC) operation closed-loop circuit in which the $CO_2$ refrigerant exiting the evaporation stage is pumped to the cooling stage.

31. The $CO_2$ cooling system as claimed in claim 30, further comprising at least one pump operatively connected to at least one of the pipes for pumping the $CO_2$ refrigerant exiting the evaporation stage to the cooling stage.

32. The $CO_2$ cooling system as claimed in claim 31, wherein the $CO_2$ refrigerant circulates in a liquid stage between the cooling stage and the evaporation stage in the FC operation mode.

33. A $CO_2$ cooling system comprising:

a compression stage in which $CO_2$ refrigerant is compressed into one of a sub-critical state and a transcritical state;

a cooling stage in which the $CO_2$ refrigerant releases heat;

an evaporation stage in which the $CO_2$ refrigerant, having released heat in the cooling stage, absorbs heat;

a plurality of pipes connecting the compression stage, the cooling stage, and the evaporation stage in which circulates the $CO_2$ refrigerant and being configured to define a normal operation closed-loop circuit in which the $CO_2$ refrigerant exiting the evaporation stage is directed to the compression stage before being directed to the cooling stage and a thermosyphon free cooling (TFC) operation closed-loop circuit in which the $CO_2$ refrigerant exiting the evaporation stage is directed to the cooling stage by at least one of gravity and natural convection; and a pressure differential unit operatively connected to at least one of the pipes downstream of the cooling stage and configurable to maintain a pressure differential between the cooling stage and at least one of a $CO_2$ reservoir and the evaporation stage in the normal operation closed-loop circuit when the $CO_2$ refrigerant is compressed into the transcritical state by depressurizing the $CO_2$ refrigerant exiting the cooling stage and the pressure differential unit being configured in an open configuration in the TFC operation closed-loop circuit allowing the $CO_2$ refrigerant to flow in both directions in the at least one of the pipes.

34. A method for operating a $CO_2$ cooling system comprising a compression stage in which $CO_2$ refrigerant is compressed into one of a sub-critical state and a transcritical state; a cooling stage in which the $CO_2$ refrigerant releases heat; an evaporation stage in which $CO_2$ refrigerant, having released heat in the cooling stage, absorbs heat, and a pressure differential unit mounted in a line between the cooling stage and the evaporation stage, the method comprising:

circulating the $CO_2$ refrigerant in a normal operation closed-loop circuit between the compression stage, the cooling stage, and the evaporation stage;

measuring an ambient temperature;

comparing the measured ambient temperature to a temperature set-point;

if the measured ambient temperature is below the temperature set-point, configuring the pressure differential unit in an open configuration allowing the $CO_2$ refrigerant to flow in both directions in the line and circulating the $CO_2$ refrigerant in a thermosyphon free cooling (TFC) operation closed-loop circuit between the cooling stage and the evaporation stage wherein the $CO_2$ refrigerant exiting the evaporation stage is directed to the cooling stage by at least one of gravity and natural convection;

if the measured ambient temperature is equal to or above the temperature set-point, circulating the $CO_2$ refrigerant in the normal operation closed-loop circuit.

35. A method for operating a $CO_2$ cooling system comprising a compression stage in which $CO_2$ refrigerant is compressed; a cooling stage in which the $CO_2$ refrigerant releases heat; an evaporation stage in which $CO_2$ refrigerant, having released heat in the cooling stage, absorbs heat, and a pressure differential unit mounted in a line between the cooling stage and the evaporation stage, the method comprising:

circulating the $CO_2$ refrigerant in a thermosyphon free cooling (TFC) operation closed-loop circuit between the cooling stage and the evaporation stage wherein the $CO_2$ refrigerant exiting the evaporation stage is directed to the cooling stage by at least one of gravity and natural convection and wherein the pressure differential unit is configured in an open configuration to allow the $CO_2$ refrigerant to flow in both directions in the line;

measuring at least one process parameter within the TFC operation closed-loop circuit;

comparing the at least one process parameter to at least one process parameter set-point; and if the at least one process parameter is below the at least one process parameter set-point, circulating the $CO_2$ refrigerant in one of the TFC operation closed-loop circuit and a normal operation closed-loop circuit between the compression stage, the cooling stage, and the evaporation stage;

if the at least one process parameter is equal to or above the at least one process parameter set-point, circulating the $CO_2$ refrigerant in the other one of the TFC operation closed-loop circuit and the normal operation closed-loop circuit.

36. A $CO_2$ cooling system comprising:

a compression stage in which $CO_2$ refrigerant is compressed into one of a sub-critical state and a transcritical state;

a cooling stage in which the $CO_2$ refrigerant releases heat;

an evaporation stage in which the $CO_2$ refrigerant, having released heat in the cooling stage, absorbs heat;

a plurality of pipes connecting the compression stage, the cooling stage, and the evaporation stage in which circulates the $CO_2$ refrigerant and being configured to define a normal operation closed-loop circuit in which the $CO_2$ refrigerant exiting the evaporation stage is directed to the compression stage before being directed to the cooling stage and a free cooling (FC) operation closed-loop circuit in which the $CO_2$ refrigerant exiting the evaporation stage is pumped to the cooling stage; and a pressure differential unit operatively connected to at least one of the pipes downstream of the cooling stage and configurable to maintain a pressure differential between the cooling stage and at least one of a $CO_2$ reservoir and the evaporation stage in the normal operation closed-loop circuit when the $CO_2$ refrigerant is compressed into the transcritical state by depressurizing the $CO_2$ refrigerant exiting the cooling stage and the pressure differential unit being configured in an open configuration in the FC operation closed-loop circuit allowing the $CO_2$ refrigerant to flow in both directions in the at least one of the pipes.

37. A $CO_2$ cooling system comprising:

a compression stage in which CO2 refrigerant is compressed;

a cooling stage in which the CO2 refrigerant releases heat;

an evaporation stage in which the CO2 refrigerant, having released heat in the cooling stage, absorbs heat; and a plurality of pipes connecting the compression stage, the cooling stage, and the evaporation stage in which circulates the CO2 refrigerant and being configured to define a normal operation closed-loop circuit in which the CO2 refrigerant exiting the evaporation stage is directed to the compression stage before being directed to the cooling stage and a thermosyphon free cooling (TFC) operation closed-loop circuit in which the CO2 refrigerant exiting the evaporation stage is directed to the cooling stage by at least one of gravity and natural convection, wherein at least one of the pipes directing $CO_2$ refrigerant exiting one of the evaporation stage and a $CO_2$ reservoir to the cooling stage is free of pump and compressor.

* * * * *